US008288639B2

(12) United States Patent
Carraro

(10) Patent No.: US 8,288,639 B2
(45) Date of Patent: Oct. 16, 2012

(54) UNION GROUP FOR LOCKING A MUSIC INSTRUMENT TO A SUPPORT ELEMENT

(76) Inventor: Alessandro Carraro, Cresole di Caldogno (IT)

( * ) Notice: Subject to any disclaimer, the term of this patent is extended or adjusted under 35 U.S.C. 154(b) by 0 days.

(21) Appl. No.: 12/734,985

(22) PCT Filed: Dec. 31, 2008

(86) PCT No.: PCT/IT2008/000825

§ 371 (c)(1),
(2), (4) Date: Aug. 5, 2010

(87) PCT Pub. No.: WO2009/084070

PCT Pub. Date: Jul. 9, 2009

(65) Prior Publication Data

US 2010/0294111 A1 Nov. 25, 2010

(30) Foreign Application Priority Data

Dec. 31, 2007 (IT) ..... VC2007A0330

(51) Int. Cl.
*G10D 13/02* (2006.01)

(52) U.S. Cl. ..... 84/421; 84/422.3

(58) Field of Classification Search ..... 84/421, 84/422.3

See application file for complete search history.

(56) References Cited

U.S. PATENT DOCUMENTS

| | | | | |
|---|---|---|---|---|
| 4,365,535 | A | 12/1982 | Buttner | |
| 4,520,710 | A * | 6/1985 | Elliott, Jr. | 84/422.1 |
| 4,960,028 | A | 10/1990 | Ramirez | |
| 5,479,843 | A | 1/1996 | Yanagisawa | |
| 6,930,233 | B2 * | 8/2005 | Hsieh | 84/422.3 |
| 2006/0027072 | A1 * | 2/2006 | Morelli | 84/422.3 |

FOREIGN PATENT DOCUMENTS

GB 2 270 192 A 3/1994

OTHER PUBLICATIONS

PCT Search Report dated May 18, 2009.

* cited by examiner

*Primary Examiner* — Jianchun Qin
(74) *Attorney, Agent, or Firm* — Hedman & Costigan, P.C.; James V. Costigan

(57) ABSTRACT

An improved union group (1) for locking a music instrument (P) to a support element (A) having a pair of support organs (2, 3), suitable to be associated with the support element (A) and to support the music instrument (P), and a seal body (4), arranged above the support organs (2, 3), and connection means (5) which permanently bind the music instrument (P) to the support organs (2, 3). The connection means (5) include a bayonet joint part of which is given by a shaped portion (6) connected with the seal body (4).

11 Claims, 3 Drawing Sheets

UNION GROUP FOR LOCKING A MUSIC INSTRUMENT TO A SUPPORT ELEMENT

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

REFERENCE TO A MICROFICHE APPENDIX

Not Applicable

BACKGROUND OF THE INVENTION (1) Field of the Invention

The present invention refers to an improved union group for locking a music instrument, for example a percussion instrument such as a cymbal of an acoustic drums, to a support element such as a rod of the drums themselves.

(2) Description of Related Art

As known, a drums is a music instrument composed, among others, by a plurality of cymbals, arranged in pairs or individually, struck during an exhibition by the drummer through special poles, also called drumsticks, made mostly of wood, plastic or their proper combination.

The cymbals are supported by a plurality of rods, for example of the type so-called "giraffe", arranged one next to the other in order to usually occupy a truncated sector of circumference which is front to the position from which the musician accesses every component of the drums to play.

The cymbals are connected with the corresponding supporting rods, placed close to a support base such as the stage for a concert, through appropriate union groups which keep the cymbals in the use position, available to the percussion by the drumsticks handled by the drummer.

In particular, in order to get a better sound, it is recommended that the cymbals are coupled with the supporting rods so that the drumstick does not hit them crosswise but it is as much parallel to them as possible in the percussions phase.

Each union group supports inferiorly and at the centre the relative cymbal so that the circular portion of this which is hit by the drumstick in order to get the sound is free, cantilevered.

However, the union groups of the known type used to lock a cymbal to a rod of a music instrument such as drums have some recognized drawbacks.

A first drawback of the union groups concerned belonging to the known art comes from the high number of components provided by them in order to get the locking of the cymbals.

Indeed, the traditional union groups include two base laminar rings coupled coaxial with an end of the supporting rod, a lower bearing and an upper bearing, arranged coaxially and superiorly to the laminar rings, the plate being clamped between said bearings.

Each of the aforesaid bearings, consisting of a cylindrical element which has an axial through hole, prevents friction between the union group and the cymbal and generates reaction forces orthogonal to the two surfaces.

The known union groups comprise, then, a coverage and seal ring, positioned above and coaxially to the upper bearing, and a fastening member, also called screwing throttle.

The fastening member is inserted into the axial through holes of each of the components just mentioned till to engage in the screw provided at the end of the supporting rod in order to carry out the definite blocking of the group as a whole and, therefore, of the cymbal.

First of all, such a constructive shape means that, through the known union groups, the assembly to the rod and disassembly from the rod operations of the cymbal are inevitably rather laborious.

Secondly, a large number of components means a reduction in the structural strength of the group, as it is clear from a statistical calculation.

A second drawback of the known union groups is due to the need to disassemble from the supporting rod and separate one from each other all the components which make it up if it is desired to remove the cymbal from the rod itself.

A further drawback, likelihood the most felt by the concerned persons, derives from the fact that the union groups of the known technique cause a certain instability in locking cymbals.

BRIEF SUMMARY OF THE INVENTION

Specifically, the supporting rod upon which the instrument rest is very narrow and the fastening member (the throttle) is screwed in order to allow a certain amplitude of movement to the instrument, otherwise the sound expansion is not good.

In doing so, however, the throttle is not well fixed and, being in close contact with the instrument, suffers the vibrations transmitted by the impact with the drumsticks through the threaded supporting rod.

The angular motion generated on the cymbal by such an impact and the friction forces with the threaded rod cause over time the loosening of the screw fastening member and the movement of the cymbal, already free in itself by virtue of the attaching system of the rod, becomes very uncontrolled under the strokes of the drumstick.

This triggers in the cymbal some cracks which spread both radially and longitudinally from the axial hole or the outer edge, often causing the definite breakdown of the cymbal and the need to replace it.

Furthermore, a cymbal which swings in heedless way after the percussion is unaesthetic and, mostly, does not produce an optimal or appropriate sound.

A broken cymbal cannot in any way be reused and if even one tries to cut the ruined contour or remake the edges thereof, practice often used by the drummers, the result is certainly not encouraging because, in use conditions, it's like to try to obtain a sound from a cardboard or wood piece.

The present invention seeks to solve the drawbacks of the known art just identified.

The main aim of the present invention is to provide an improved union group for locking a music instrument to a support element which under certain conditions, leads to a structural stability that is better than equivalent union groups of the known type, while keeping unchanged the ability of the music instrument to provide an optimal and compliant sound.

In other words, primary aim of invention is to make available an improved union group which, compared to the prior art, reduces the risks of loosening the coupling between music instrument and support element.

Within such an aim, it is task of the present invention to eliminate or at least severely limit with respect to the known art the origin or the formation of cracks on the music instrument.

As a consequence, it is task of the current invention to lower with respect to the known art the percentage of music instruments, such as the cymbals of a drums, which break and must be replaced after a performance.

It is another aim of the invention to provide an improved union group which allows to apply a music instrument to a support element, and also to separate it from the latter, more quickly and conveniently than what happens in the current state.

It is another aim of the invention to develop an improved union group for locking a music instrument to a support element which presents a lower number of components compared to known union groups.

It is a last but not least aim of the invention to concrete an improved union group for locking a music instrument to a support element consistent with the sector technologies already in use.

These aims are achieved by an improved union group for locking a music instrument to a support element as the attached claim 1, to which they refer for the sake of brevity.

Additional features of detail of the improved union group according to the invention are set forth in the dependent claims.

Advantageously, in application conditions the improved union group of the invention implies a structural stability greater than the prior technique since the bayonet joint of the connection means determines a coupling more secure and lasting over time between the two linked pieces.

Hence, the invention highly reduces the risks that over time, under the percussion of the drumsticks, the coupling between the components looses, limiting also the critical conditions in which the cymbal is too much uncontrolled despite still being hung to the supporting rod.

Still advantageously, the union group of the invention assures that the music instrument keeps its structural integrity for a time longer than those ones offered by equivalent union groups of the known type.

This depends on the fact that, in application conditions, the extremely high stability offered by the union group of the invention prevents the formation of cracks on the music instrument, typical of the current state of the art.

Ultimately, the music instrument, when struck by the musician through a drumstick, emits the desired and optimal sound at least for times longer than those ones guaranteed nowadays.

Equally advantageously, the union group of the invention includes a number of components lower than known union groups, as a consequence of which the union group of the invention presents a series of not slight advantages compared to the known art, such as:

- ease and speed of assembly to the support element and disassembly from the latter;
- greater strength in terms of application;
- particularly pleasant aesthetic impact.

The assembly and disassembly simplicity of the union group of the invention comes also from the fact that the removal of the music instrument (the cymbal) from a support element (the rod of a drums) occurs still leaving the first coupled with the support organs and the upper seal body, without the need to separate one by one these components from the support element, as it happens, however, with the known improved union groups.

BRIEF DESCRIPTION OF THE SEVERAL VIEWS OF THE DRAWINGS

Said aims and advantages, as well as others emerging during the paper, will appear to a greater extent from the description of a preferred embodiment of the invention, given as illustrative but not limiting way with reference to the following drawings in which.

Figure 1:
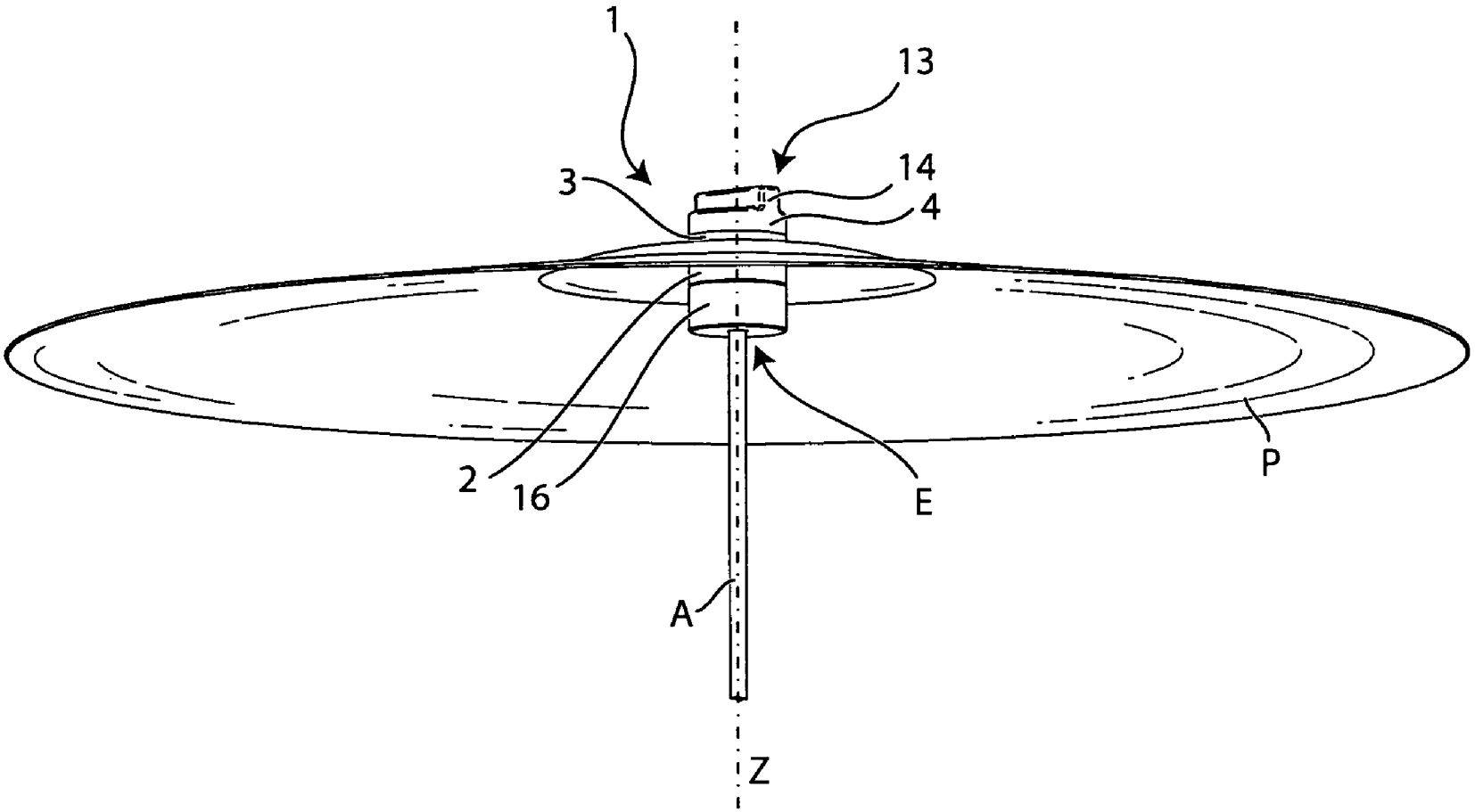
FIG. 1 is the assonometric view of the union group of the invention in applicative phase.

The improved union group 1 for locking a music instrument to a support element is illustrated in FIG. 1.

Specifically, the music instrument and the support element are members of a drums, representing respectively a cymbal P and a rod A, shown truncated in FIG. 1.

As noted, the union group 1 consists of a pair of support organs 2, 3, which are associated with the support element A and directly support the music instrument P.

The union group 1 also includes a seal body 4 arranged close to one of the support organs 2, 3: in particular, the seal body 4 is located above the support organ 3.

In addition, the union group 1 consists of connection means, as a whole indicated with 5, suitable to firmly bind the music instrument P to the support organs 2, 3.

According to the invention, the connection means 5 include a bayonet joint, indicated as a whole with 6, part of which is given by a shaped portion 7 connected with the seal body 4.

Figure 2:
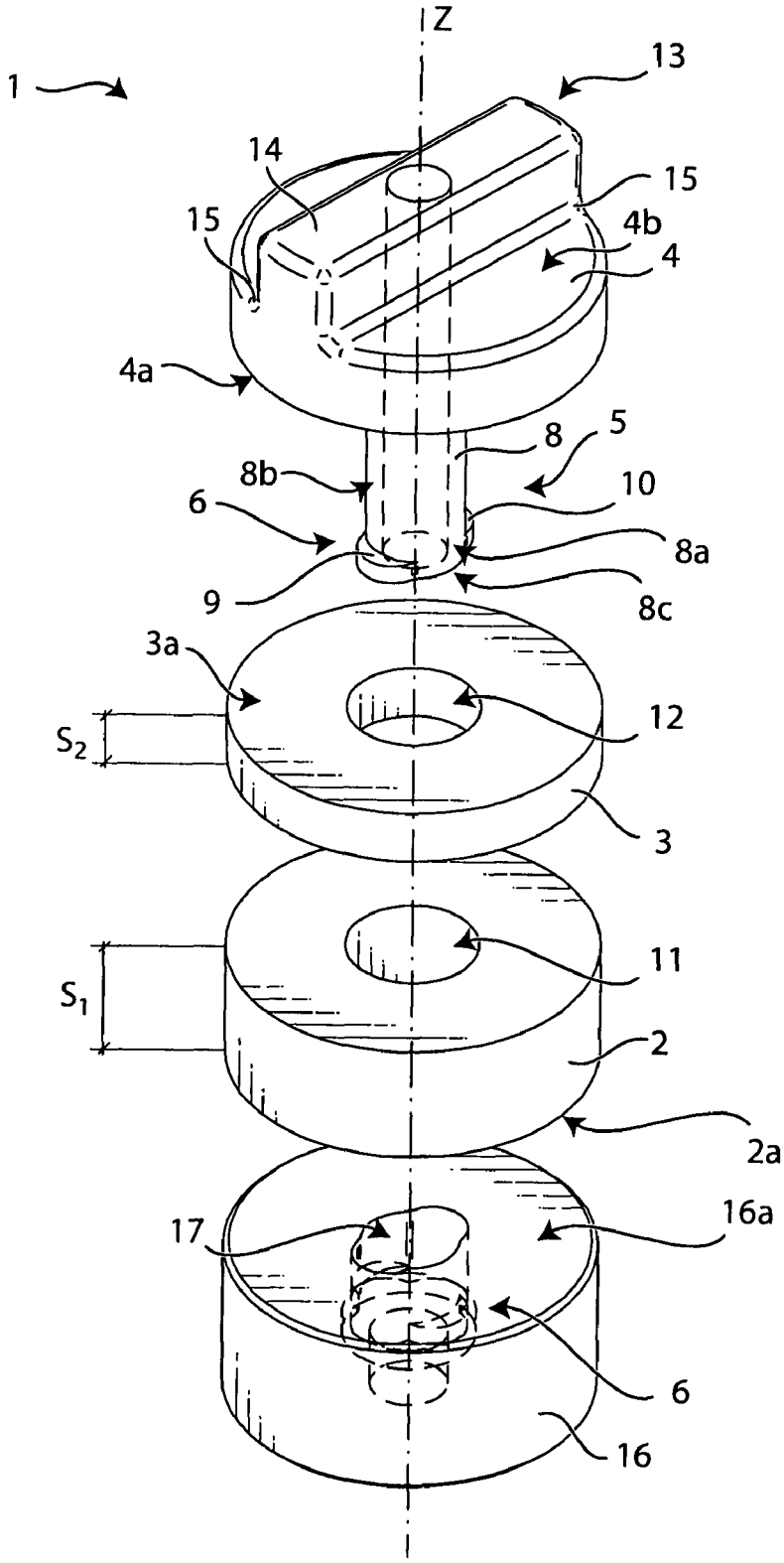
FIG. 2 is the exploded assonometric view of the union group of the invention.

FIG. 2 shows that, at preferential title, the shaped portion 7 comprises a cylindrical stem 8 which defines a longitudinal axis of rotation Z and at an end 8*a* is provided with a pair of tongues 9, 10, protruding from the outer surface 8*b* of the cylindrical stem 8 symmetrically relative to the axis of rotation Z and according to a plane perpendicular to the axis of rotation Z.

In the case at issue, moreover, the shaped portion 7 is monolithic with the seal body 4 and protrudes according to the axis of rotation Z from the lower surface 4*a* of the seal body 4.

As far as the support organs 2, 3 are concerned, each of them presents a central through hole 11, 12 into which the cylindrical stem 8 is inserted and which remains projecting for a terminal stretch from the support organs 2, 3 along the axis of rotation Z.

More specifically, each of the support organs 2, 3 comprises a cylindrical element made of polymeric material suitable to absorb elastic deformations.

Preferably but not necessarily, the polymeric material includes a synthetic rubber based on polychloroprene, synthesis elastomer or polymeric form of the chloroprene also known under the Trademark® of Neoprene which, among the other features, has elasticity and resistance to cutting.

More in detail, the polymeric material of the support organs or bearings presents a Poisson's modulus v equal to about 0.5.

It is recalled here that Poisson's modulus v measures the degree with which a sample of material shrinks or expands transversely in presence of unidirectional longitudinal stress.

The thickness of the support organs 2, 3 depends on the locking degree which is desired to assign to the music instrument P.

In particular, in FIG. 2 it is observed that the support organs 2, 3 present different thicknesses: indeed, the lower support organ 2 presents a thickness "$S_1$" greater than the thickness "$S_2$" of the upper support organ 3.

This by virtue of the fact that the support organ 2 must give stability, support the cymbal P and create a significant reaction force, while the support organ 3 must simply create a further normal force for a more secure locking and prevent the direct contact of the cymbal P with the seal body 4.

The presence of the support organs 2, 3 is useful in order to prevent that the music instrument P touches the seal body 4 and the other parts involved in the coupling of the music instrument P with the support element A.

The friction that would be otherwise generated by the continuous contact of the music instrument P for example with the seal body 4 damages, in fact, the finishing of the central hole, not visible, of the music instrument P, thereby creating the possibility of forming radial cracks on the instrument P and its consequent impossibility of use.

The support organs 2, 3 also have the important function of reducing the transmission of the vibrations suffered by the support element A that otherwise affect in a negative manner the sound of the music instrument P.

It is understood that even the support organs 2, 3 contribute in creating stability for the music instrument P, allowing its movement always in a defined range of values and the return to the rest position in a time shorter than the time spent with the current union groups.

FIGS. 1 and 2 show that the seal body 4 presents a cylindrical shape and comprises handle means, overall numbered with 13 and at user's disposal, which facilitate the grip and the rotation of the seal body 4 around the axis Z, especially in application conditions.

In this case, only by way of example, the handle means 13 include a parallelepiped small block 14, protruding from the upper surface 4*b* of the seal body 4 to which is connected through a curved junction 15.

According to the preferred embodiment here described of the invention, the improved union group 1 includes a base body 16, in which an axial through hole 17 is defined.

The base body 16, having preferably a cylindrical shape, is coupled with an end E of the support element A to interpose itself between the support organs 2, 3 and the support element A.

Figure 3:
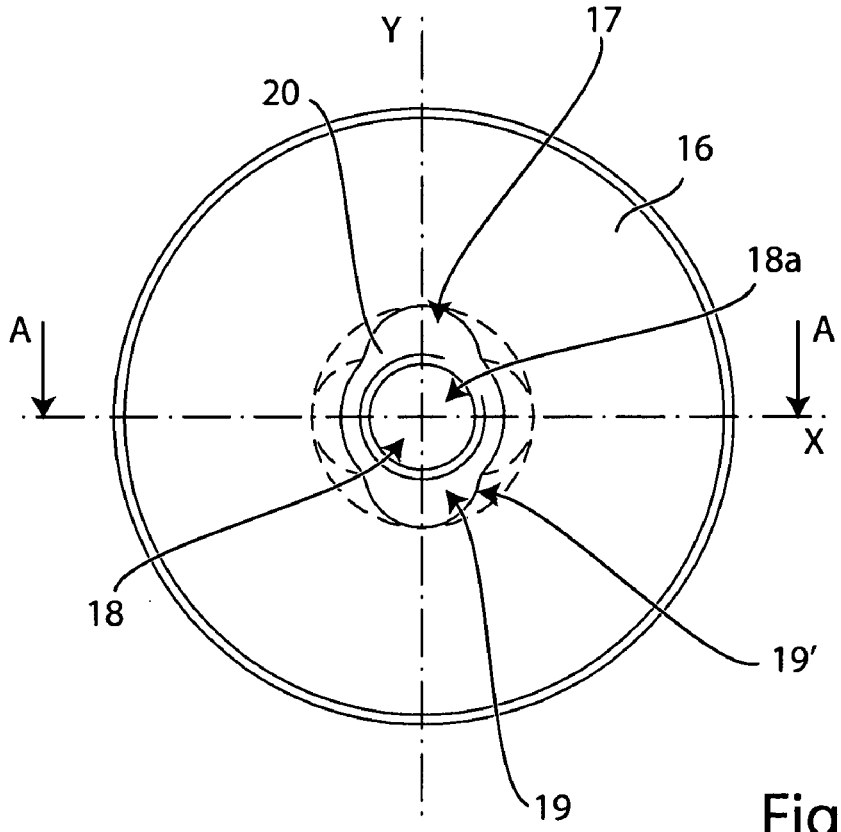
FIG. 3 is the top view of a particular of FIG. 2.
Figure 4:
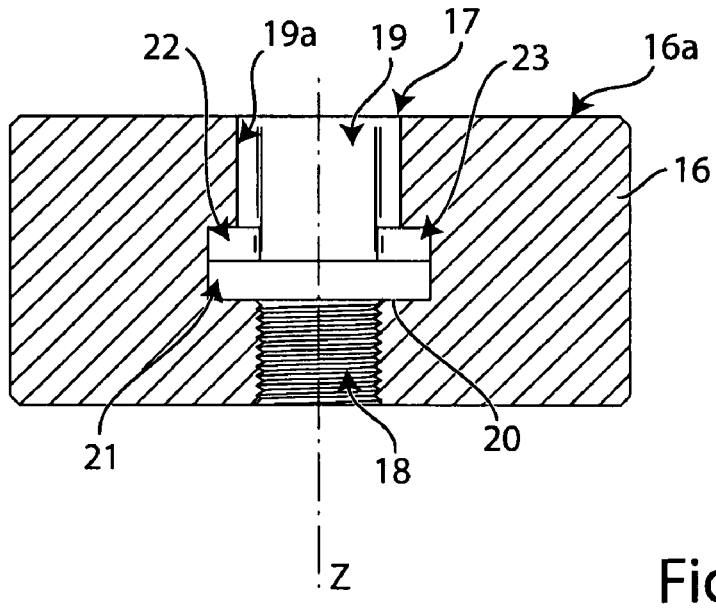
FIG. 4 is the side view of FIG. 3 according to the cutting plane A-A.

FIGS. 3 and 4 show that the axial through hole 17 is divided into:

- a lower screw nut 18 which engages with a screw, not visible, made at the end E of the support element A;
- an upper hole 19, facing the support organ 2 and communicating with the lower nut screw 18 compared to which presents larger dimensions, suitable to receive the shaped portion 7 giving rise to the remaining part of the bayonet joint 6.

The lower screw nut 18 has a M8 thread with a pitch of 1.25 mm integral with the thread of the end E of the support element A, typically a rod of a drums, manufactured by all the production firms.

As highlighted in FIG. 3, the upper hole 19 presents in cross section a substantially elliptical profile 19' which defines a major axis Y and a minor axis X.

The lower screw nut 18 and the upper hole 19 of the axial hole 17 define inside the base body 16 a ledge wall 20 close to which the lower edge 8*c* and the tongues 9, 10 of the cylindrical stem 8 strike.

More precisely, the ledge wall 20 surrounds the inlet 18*a* of the lower screw nut 18 of the axial hole 17.

FIG. 4 shows that the inner wall 19*a* which delimits the upper hole 19 of the axial hole 17 has at the ledge wall 20 an annular groove 21 which receives the tongues 9, 10 of the cylindrical stem 8 and allows the rotation around the axis Z thereof.

In other embodiments of the invention, not followed by reference drawings, the inner wall of the upper hole will present more annular grooves, one below the other along the axis of rotation.

Such a constructive measure, allowed where the thickness of the support organ is appropriate, permits to decide at will, varying it, the degree of blockage of the music instrument to the support element through the improved union group of the invention.

The annular groove 21 presents a diameter substantially equal to the length of the major axis Y of the profile 19' of the upper hole 19 of the axial hole 17.

In preferred but not binding way, the inner wall 19*a* delimiting the upper hole 19 presents at a perimetrical edge, not shown, above the annular groove 21 two restraining notches 22, 23, made at the height of the minor axis X of the profile 19' of the upper hole 19.

These restraining notches 22, 23 prevent the accidental rotation of the shaped portion 7 with respect to the base body 16 once the tongues 9, 10 are positioned at the restraining notches 22, 23.

In other embodiments of the invention, the inner wall of the upper hole could also have only one restraining notch.

At preferential title, the base body 16, the support organs 2, 3 and the seal body 4 are reciprocally coaxial along the axis of rotation Z.

From FIG. 2 it is also derived that the upper edge 16*a* of the base body 16 is arranged close to the lower edge 2*a* of the support organ 2, while the upper wall 3*a* of the support organ 3 is arranged close to the lower surface 4*a* of the seal body 4.

Operatively, the drummer or other operator, after having arranged the support element A on a support base, such as the floor of a room or the stage, screws the base body 16 in the end E of the support element A itself.

The screwing occurs between the lower screw nut 18 and the screw provided at the end E of the support element A.

After the completion of this operation, the music instrument P is interposed coaxial between the support organs 2, 3; the resulting set is coupled with the cylindrical stem 8 by inserting the latter into the central holes 11, 12 and the hole of the music instrument P.

Subsequently, the seal body 4 integral with the support organs 2, 3 and the music instrument P is coupled with the base body 16 by introducing the cylindrical stem 8 into the upper hole 19 of the axial hole 17.

The introduction of the cylindrical stem 8 into the upper hole 19 ends when the lower edge 8*c* and the tongues 9, 10 strike against the ledge wall 20.

At that point, the operator, acting conveniently on the handle means 13, rotates of 90° around the axis Z the seal body 4 and, consequently, the cylindrical stem 8 integral with it, giving rise to the bayonet joint 6 between the latter and the base body 16.

Before and during the aforesaid rotation, the operator forces the support organ 2 close to the base body 16, slightly compressing both support organs 2, 3 due to the intrinsic elasticity of the polymeric material which composes them.

Once the rotation of the cylindrical stem 8 inside the base body 16 is completed, the operator releases the handle means 13 and, thanks to the elastic recovery of the support organs 2, 3, combines the tongues 9, into the restraining notches 22, 23, creating the definitive locking of the union group 1 and the music instrument coupled with it to the support element A.

The operation of disassembling the union group 1 from the support element A obviously occurs according to the same operations performed in reverse order.

Compared to the known art, however, it will be necessary neither to remove all the members of the union group 1 of the invention here described from the support element A, nor to separate the music instrument P from the set constituted by the support organs 2, 3 and the seal body 4.

Acting on the handle means 13 of the seal body 4, simply the cylindrical stem 8, which still leads the support organs 2, 3 and the music instrument P among them coaxial, is extracted from the upper hole 19 of the axial hole 17 and in case of need is coupled with a new adjacent support element A, in a way completely similar to what just explained.

On the basis of what set forth above, it is, therefore, understood that the improved union group for locking a music instrument to a support element of the invention reaches the aims and realizes the advantages mentioned above.

In execution, changes can be made to the improved union group according to the invention, consisting, for example, in a number of support organs different from that one shown in the drawings which follow and used as reference for the previous description.

Moreover, there could be other embodiments of the union group subject to protection in which the bayonet joint can consist of pieces of the union group different from those mentioned above, which does not affect the advantage provided by the present invention.

It is, finally, clear that many other variations can be made to the improved union group of the invention, without for this reason going out of the novelty principles inherent of the inventive idea, as it is clear that, in the practical implementation of the invention, materials, shapes and dimensions of the illustrated details could be any, depending on the needs, and may be replaced with others technically equivalent.

The invention claimed is:

1. An improved union group (1) for locking a music instrument (P) to a support element (A) including: one or more support organs (2, 3) suitable to be associated with said support element (A) and to support said music instrument (P); a seal body (4) arranged close to at least one of said support organs (2, 3); connection means (5) suitable to permanently bind said music instrument (P) to said support organs (2, 3), characterized in that said connection means (5) include a bayonet joint (6), a part of which is given by a shaped portion (7) connected with said seal body (4) wherein said shaped portion (7) comprises a cylindrical stem (8) which defines a longitudinal axis of rotation (z) and at an end (8*a*) is provided with a pair of tongues (9, 10) protruding from the outer surface (8*b*) of said cylindrical stem (8) symmetrically with respect to said axis of rotation (Z) and according to a plane orthogonal to said axis of rotation (Z) and having a base body (16) in which an axial through hole (17) is defined, suitable to be coupled with an end (E) of said support element (A) to interpose itself between said support organs (2, 3) and said support element (A) wherein said axial through hole (17) is divided into: a lower nut screw (18) suitable to engage with a screw made in said end (E) of said support element (A); an upper hole (19), facing one of said support organs (2, 3) and communicating with said lower screw nut (18) compared to which presents larger dimensions, suitable to receive said shaped portion (7) giving rise to the remaining part of said bayonet joint (6) and wherein said upper hole (19) presents in cross section a substantially elliptical profile (19') which defines a, major axis (Y) and a minor axis (X), and wherein said lower screw nut (18) and said upper hole (19) of said axial hole (20) define inside said base body (16) a ledge wall (20) close to which the lower edge (8*c*) and said tongues (9, 10) of said cylindrical stem (8) strike and wherein the inner wall (19*a*) which delimits said upper hole (19) of said axial hole (17) has at said ledge wall (20) at least one annular groove (21) suitable to receive said tongues (9, 10) of said cylindrical stem (8).

2. The improved union group (1) as defined in claim 1 characterized in that said annular groove (21) presents a diameter substantially equal to the length of said major axis (Y) of said profile (19') of upper hole (19) of said axial hole (17).

3. The improved union group (1) as defined in claim 1 characterized in that said inner wall (19*a*) delimiting said upper hole (19) presents at a perimetrical edge above said annular groove (21) at least one restraining notch (22, 23), made at the height of said minor axis (X) of said profile (19') of said upper hole (19), suitable to prevent the accidental rotation of said shaped portion (7) with respect to said base body (16).

4. The improved union group (1) as defined in claim 1 characterized in that said base body (16), said support organs (2, 3) and said seal body (4) are reciprocally coaxial along said axis of rotation (z).

5. Improved union group (1) as defined in claim 1 characterized in that each of said support organs (2, 3) presents a central through hole (11, 12) into which said cylindrical stem (8) is inserted, which remains projecting for a terminal stretch from said support organs (2; 3) along said axis of rotation (Z).

6. The improved union Group (1) as defined in claim 1 characterized in that the upper edge (16*a*) of said base body (16) is arranged close to the lower edge (2*a*) of one of said support organs (2, 3).

7. The improved union group (1) as defined in claim 1 characterized in that each of said support organs (2; 3) comprises a cylindrical element made of polymeric material capable to absorb elastic deformations.

8. The improved union group (1) as defined in claim 7 characterized in that said polymeric material comprises a synthetic rubber based on polychloroprene.

9. The improved union group (1) as defined in claim 7 characterized in that said polymeric material presents Poisson's modulus (v) equal to about 0.5.

10. The improved union group (1) as defined in claim 1 characterized in that the thickness of said support organs (2, 3) depends on the locking degree which is desired to assign to said music instrument (P).

11. The improved union group (1) as defined in claim 1 characterized in that said seal body (4) comprises handle means (13) at user's disposal, suitable to facilitate the grip and the rotation of said seal body (4) around said axis of rotation (Z).

* * * * *